US011424537B2

(12) United States Patent
Uno et al.

(10) Patent No.: US 11,424,537 B2
(45) Date of Patent: Aug. 23, 2022

(54) ANTENNA DEVICE

(71) Applicant: Panasonic Intellectual Property Management Co., Ltd., Osaka (JP)

(72) Inventors: Hiroyuki Uno, Ishikawa (JP); Tomoaki Nishikido, Ishikawa (JP); Hiroyuki Uejima, Ishikawa (JP); Yuichi Kashino, Ishikawa (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 27 days.

(21) Appl. No.: 17/046,550

(22) PCT Filed: Apr. 8, 2019

(86) PCT No.: PCT/JP2019/015329
§ 371 (c)(1),
(2) Date: Oct. 9, 2020

(87) PCT Pub. No.: WO2019/198666
PCT Pub. Date: Oct. 17, 2019

(65) Prior Publication Data

US 2021/0036423 A1 Feb. 4, 2021

(30) Foreign Application Priority Data

Apr. 12, 2018 (JP) ..... JP2018-076909

(51) Int. Cl.
*H01Q 5/35* (2015.01)
*H01Q 1/38* (2006.01)
(Continued)

(52) U.S. Cl.
CPC ..... *H01Q 5/35* (2015.01); *H01Q 1/38* (2013.01); *H01Q 1/48* (2013.01); *H01Q 21/06* (2013.01)

(58) Field of Classification Search
CPC .. H01Q 5/35; H01Q 1/38; H01Q 1/48; H01Q 21/06
(Continued)

(56) References Cited

U.S. PATENT DOCUMENTS

2015/0311589 A1 10/2015 Yokoyama et al.

FOREIGN PATENT DOCUMENTS

JP H03-270304 A 12/1991
JP H03270304 * 12/1991
WO 2014/097846 A1 6/2014

OTHER PUBLICATIONS

International Search Report, dated Jun. 18, 2019, for corresponding International Application No. PCT/JP2019/015329, 2 pages.

* cited by examiner

*Primary Examiner* — Andrea Lindgren Baltzell
(74) *Attorney, Agent, or Firm* — Seed IP Law Group LLP

(57) ABSTRACT

Provided is an antenna device with a simple configuration, said antenna device supporting a plurality of frequency bands. An antenna device according to the present invention is provided with: at least one first radiation element that is provided on one surface of a substrate and that has a resonant frequency in a first frequency band; at least one second radiation element provided on the one surface of the substrate; a connection line for connecting the first radiation element and the second radiation element on the one surface of the substrate; a conductor that is provided at a position facing the first radiation element in the interior of the substrate and that has a slot; and a power supply line for supplying power to the first radiation element via the slot. The connection line is connected to the center portion, of the first radiation element, in a direction along the direction of polarization of radio waves radiated due to resonance. The line length formed of the first radiation element, the con-
(Continued)

nection line, and the second radiation element is set to a length so as to have a resonant frequency in a second frequency band lower than the first frequency band.

7 Claims, 8 Drawing Sheets

(51) Int. Cl.
*H01Q 1/48* (2006.01)
*H01Q 21/06* (2006.01)
(58) Field of Classification Search
USPC ..... 343/846
See application file for complete search history.

ANTENNA DEVICE

TECHNICAL FIELD

The present disclosure relates to an antenna apparatus.

BACKGROUND ART

In recent years, the amount of communication data traffic in radio communication has been increasing. With the increase in communication data traffic, use of new frequency bands has been considered for radio communication.

In a case where a new frequency band is used, an apparatus performing radio communication (for example, a mobile terminal) requires an antenna adaptable to the new frequency band. On the other hand, it is difficult for a small and thin mobile terminal to ensure a space in which an antenna adaptable to the new frequency band is disposed.

Accordingly, for high-speed, large-capacity radio communication with an increasing amount of communication data traffic, multiband antenna technology with one antenna adaptable to a plurality of frequency bands has been considered.

For example, Patent Literature (hereinafter, referred to as "PTL") 1 discloses a multiband antenna including antenna elements adaptable to low and high frequency bands, respectively, and blocking circuits configured to block transmission of signals between an antenna element for the low frequency band and an antenna element for the high frequency band.

CITATION LIST

Patent Literature

PTL 1
WO 2014-097846

SUMMARY OF INVENTION

Technical Problem

However, the multiband antenna disclosed in PTL 1 has a complicated antenna configuration due to the provision of the blocking circuits configured to block transmission of signals between the antenna element for the low frequency band and the antenna element for the high frequency band.

One non-limiting and exemplary embodiment of the present disclosure facilitates providing an antenna apparatus having a simple configuration and adaptable to a plurality of frequency bands.

An antenna apparatus according to an embodiment of the present disclosure includes: at least one first radiation element provided on one surface of a substrate and having a resonance frequency in a first frequency band; at least one second radiation element provided on the one surface of the substrate; a connection line connecting between the first radiation element and the second radiation element on the one surface of the substrate; a conductor provided at a position facing the first radiation element in an interior of the substrate and including a slot; and a power supply line supplying power to the first radiation element via the slot, wherein the connection line is connected to a center portion of the first radiation element, in a direction along a polarization direction of radiated radio waves generated by resonance, and a line length formed by the first radiation element, the connection line, and the second radiation element is set to a length so as to have a resonance frequency in a second frequency band lower than the first frequency band.

It should be noted that general or specific embodiments may be implemented as a system, an apparatus, an integrated circuit, a computer program or a storage medium, or may be implemented as any combination of a system, an apparatus, a method, an integrated circuit, a computer program, and a storage medium.

An embodiment of the present disclosure facilitates providing an antenna apparatus having a simple configuration and adaptable to a plurality of frequency bands.

Additional benefits and advantages of the disclosed embodiment will become apparent from the specification and drawings. The benefits and/or advantages may be individually obtained by the various embodiments and features of the specification and drawings, which need not all be provided in order to obtain one or more of such benefits and/or advantages.

DESCRIPTION OF EMBODIMENTS

Hereinafter, embodiments of the present disclosure will be described in detail with reference to the accompanying drawings. Note that, each of the embodiments described below is merely exemplary, and the present disclosure is not limited by these embodiments.

EMBODIMENT

An embodiment of the present disclosure will be described in detail with reference to the accompanying drawings.

Figure 1A:
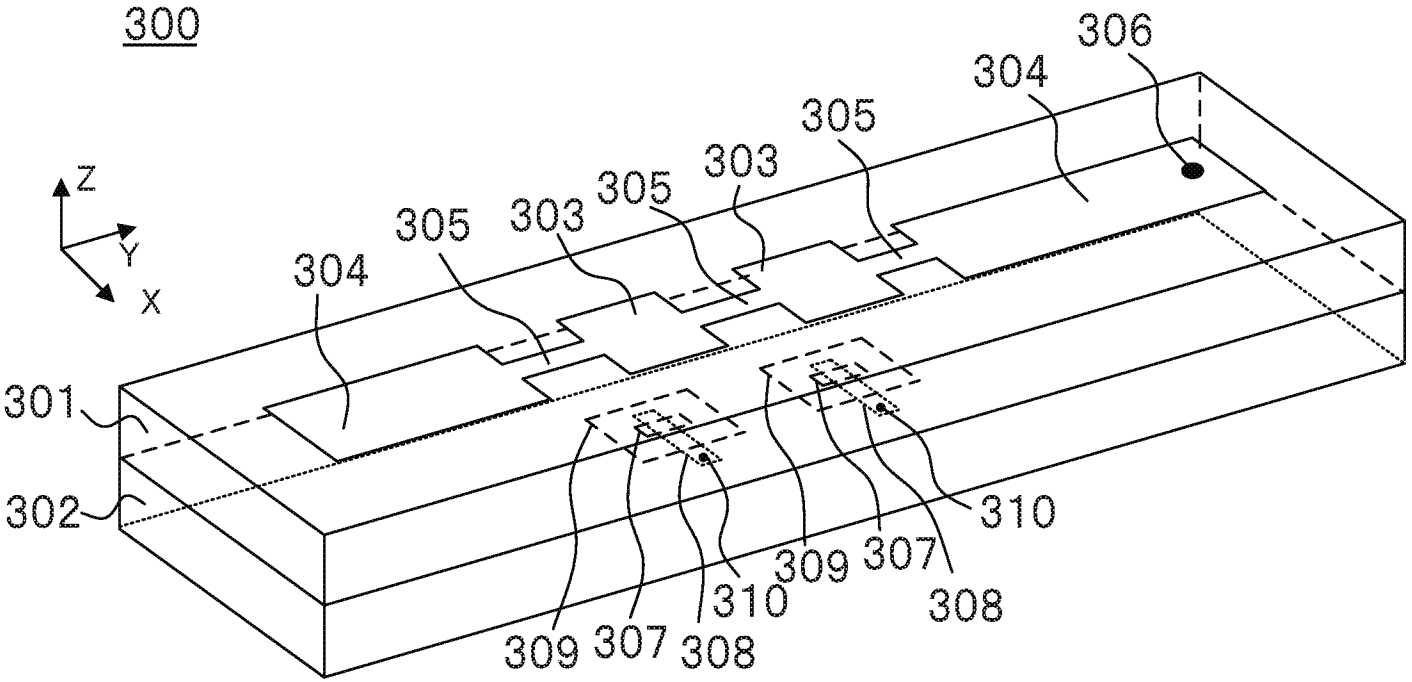
FIG. 1A is a perspective view of an example of an appearance of a multiband antenna according to an embodiment of the present disclosure.
Figure 1B:
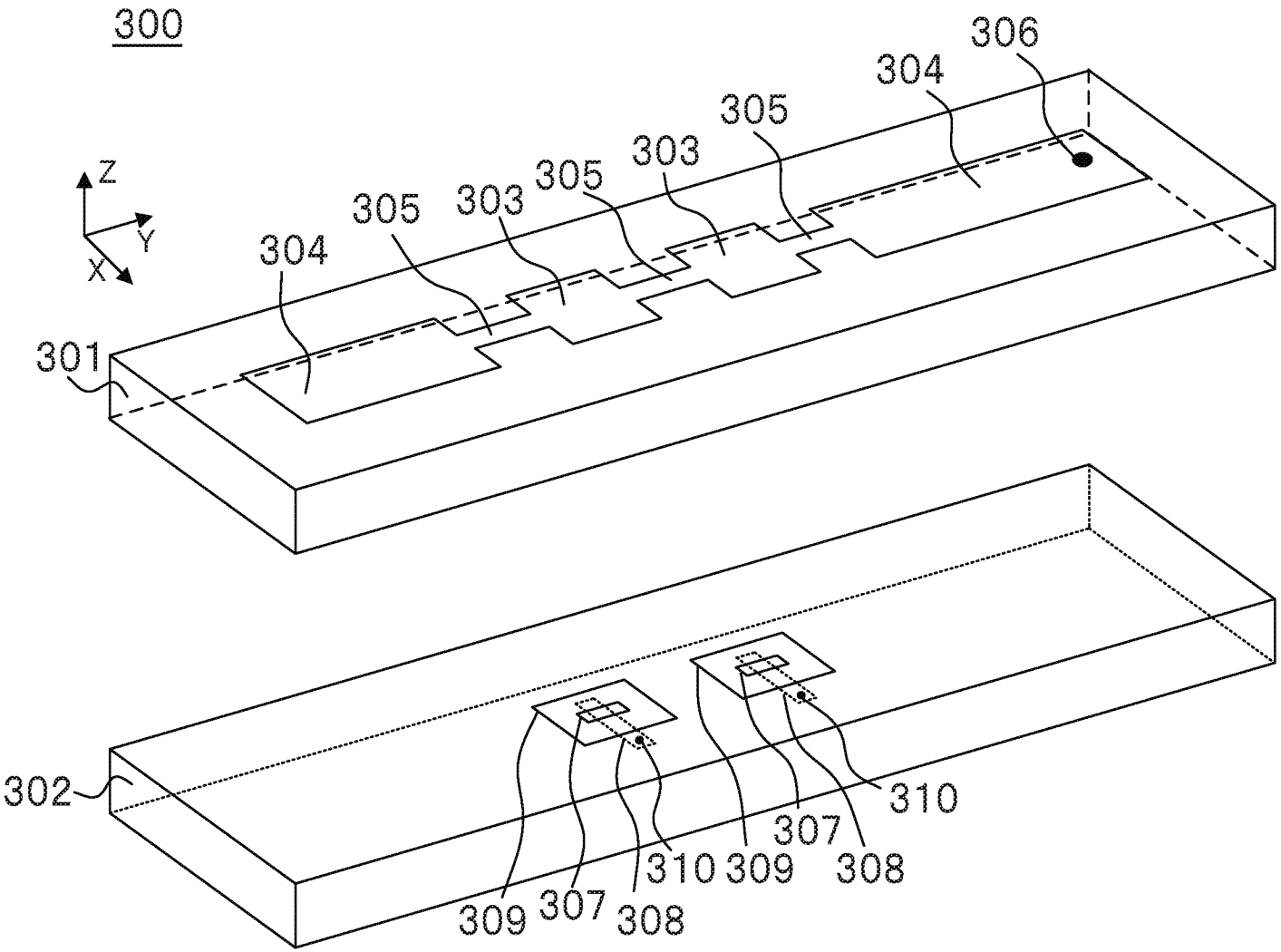
FIG. 1B is an exploded perspective view of an example of the multiband antenna according to the embodiment of the present disclosure.
Figure 1C:
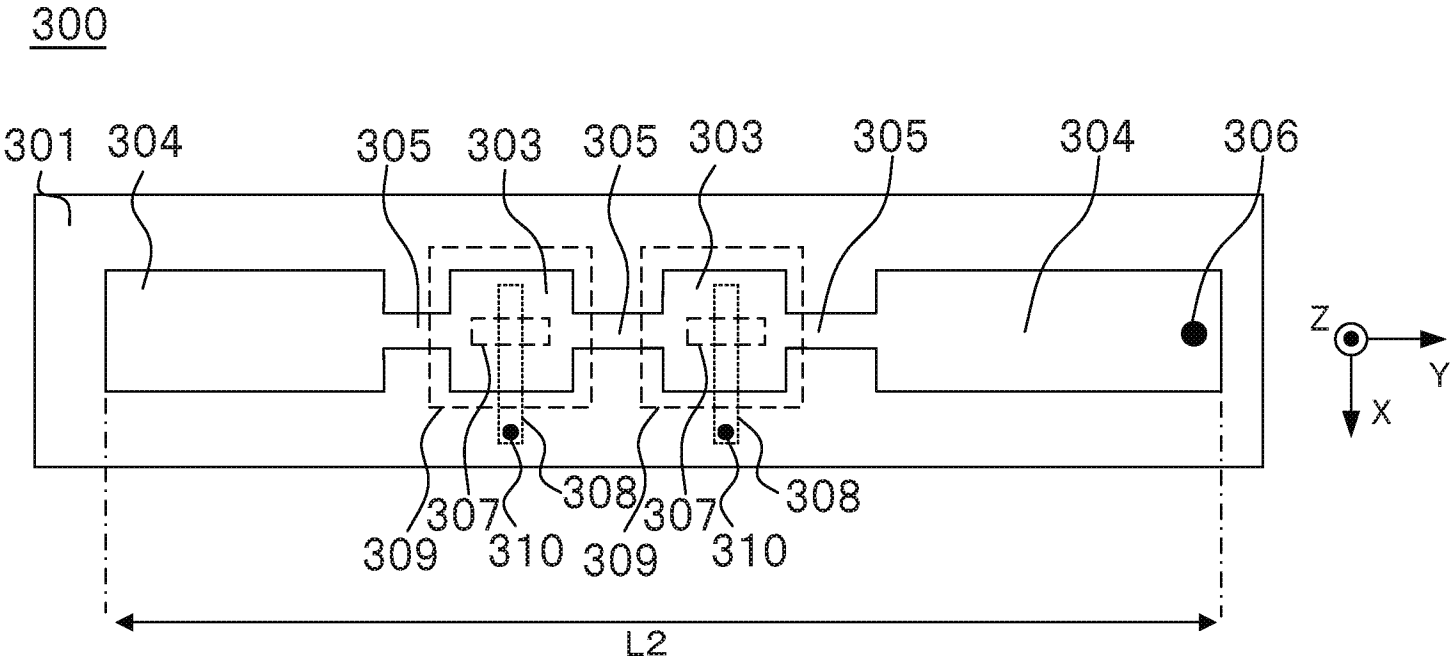
FIG. 1C is a plan view of the example of the multiband antenna according to the embodiment of the present disclosure.

FIG. 1A is a perspective view of an example of an appearance of multiband antenna 300 according to the embodiment of the present disclosure. FIG. 1B is an exploded perspective view of an example of multiband antenna 300 according to the embodiment of the present disclosure. FIG. 1C is a plan view of the example of multiband antenna 300 according to the embodiment of the present disclosure.

FIGS. 1A, 1B, and 1C illustrate an X axis, a Y axis, and a Z axis. The X axis, the Y axis, and the Z axis correspond to the width, length, and height (thickness) of multiband antenna 300, respectively.

Multiband antenna 300 is provided, for example, on a multilayer substrate including first dielectric 301 and second dielectric 302. In the multilayer substrate, multiband antenna 300 is configured with, for example, a conductor (or conductive) pattern. The conductor pattern is configured by using, for example, an etching technique. For example, multiband antenna 300 is configured with a copper foil pattern.

Second dielectric 302 is, for example, a both-surface copper-clad substrate configured by using a core material. First dielectric 301 is configured, for example, by using a prepreg. The multilayer substrate is configured by bonding first dielectric 301 and second dielectric 302. Note that, of two surfaces facing each other in the Z-axis direction of first dielectric 301, a surface in the positive direction of the Z axis may be referred to as "upper surface" of first dielectric 301, and a surface in the negative direction of the Z axis may be referred to as "lower surface" of first dielectric 301. Further, of two surfaces facing each other in the Z-axis direction of second dielectric 302, a surface in the positive direction of the Z axis may be referred to as "upper surface" of second dielectric 302, and a surface in the negative direction of the Z axis may be referred to as "lower surface" of second dielectric 302.

First dielectric 301 may have a relative permittivity that is the same as or different from the relative permittivity of second dielectric 302.

Note that, although the present embodiment indicates an example in which multiband antenna 300 is provided on a multilayer substrate including a plurality of dielectric layers, multiband antenna 300 may be provided on a substrate that does not include a dielectric.

Multiband antenna 300 includes high-frequency element 303, low-frequency element 304, radiation element connection line 305, low-frequency power supplier 306, conductor 309 provided with slot 307, high-frequency power supply line 308, and high-frequency power supplier 310.

Multiband antenna 300 operates in a first frequency band and in a second frequency band lower than the first frequency band. For example, multiband antenna 300 supports transmission and/or reception of a radio signal in the first frequency band, and supports transmission and/or reception of a radio signal in the second frequency band. In the following description, "high frequency" corresponds to the first frequency band, and "low frequency" corresponds to the second frequency band.

Two high-frequency elements 303 have, for example, a rectangular shape on an X-Y plane, and are arranged in the Y-axis direction on one of the two surfaces (for example, the upper surface of the FIGS. 1A and 1B) facing each other in the Z-axis direction of first dielectric 301. Each of two high-frequency elements 303 is an antenna element that operates (in other words, resonates) in the first frequency band, and has a resonance frequency (referred to as "first resonance frequency" for convenience) in the first frequency band. For example, the first frequency band is 28 GHz band.

High-frequency element 303 includes sides with a length of $\lambda_{e1}/2$ in the X-axis direction and in the Y-axis direction. $\lambda_{e1}$ is an effective wavelength which corresponds to the first resonance frequency, and in which a wavelength reduction of a dielectric is taken into consideration. For example, $\lambda_{e1}$ is a wavelength obtained by multiplying a wavelength of the first resonance frequency in a vacuum by a coefficient determined based on a relative permittivity of the dielectric. Note that, the dielectric to be taken into consideration represents, for example, both first dielectric 301 and second dielectric 302.

Two low-frequency elements 304 have, for example, a rectangular shape on the X-Y plane, and are arranged at positions sandwiching high-frequency elements 303 in the Y-axis direction on the upper surface of first dielectric 301.

For example, three radiation element connection lines 305 are disposed on the upper surface of first dielectric 301, and connect between two high-frequency elements 303, and between high-frequency element 303 and low-frequency element 304 (two sets). Radiation element connection line 305 has a width (a length in the X-axis direction) that is, for example, shorter than the length of a side of high-frequency element 303.

Note that, a position at which radiation element connection line 305 is connected to high-frequency element 303 will be described later.

In first dielectric 301, a pattern that includes two high-frequency elements 303, two low-frequency elements 304, and three radiation element connection lines 305, and that extends in the Y-axis direction is an antenna element operating in the second frequency band lower than the first frequency band. For example, the second frequency band is 2 GHz band. Hereinafter, the pattern extending in the Y-axis direction in first dielectric 301 may be referred to as low-frequency antenna pattern for convenience.

Length L2 in the Y-axis direction of the low-frequency antenna pattern is set to, for example, a length resonating in the second frequency band, in other words, a length in which the low-frequency antenna pattern has a resonance frequency in the second frequency band (referred to as "second resonance frequency" for convenience). Length L2 is, for example, $\lambda_{e2}/4\times N$ (where N is an integer of one or more). $\lambda_{e2}$ is an effective wavelength which corresponds to the second resonance frequency, and in which a wavelength reduction of a dielectric is taken into consideration. For example, $\lambda_{e2}$ is a wavelength obtained by multiplying a wavelength of the second resonance frequency in a vacuum by a coefficient determined based on a relative permittivity of the dielectric. Note that, the dielectric to be taken into consideration represents, for example, both first dielectric 301 and second dielectric 302.

Low-frequency power supplier 306 is provided, for example, in an end portion of one of two low-frequency elements 304, and supplies power to the low-frequency antenna pattern including low-frequency element 304. For example, low-frequency power supplier 306 is electrically connected to a low-frequency radio controller (not illustrated). The low-frequency radio controller controls the power supply from low-frequency power supplier 306 to low-frequency element 304.

A configuration in which the low-frequency antenna pattern and low-frequency power supplier 306 are included, and in which radio waves in the second frequency band are radiated may be referred to as "low-frequency radiator" for convenience.

Two conductors 309 are formed by conductor patterns having a rectangular shape at positions (for example, positions in the negative direction of the Z axis with respect to high-frequency elements 303) corresponding to two high-frequency elements 303, respectively, on the upper surface of second dielectric 302. For example, in conductor 309, each side of the rectangular shape has a length longer than that of each side of high-frequency element 303, and conductor 309 has a function of a reflector that reflects radio waves radiated from high-frequency element 303 in the negative direction of the Z axis.

Note that, two conductors 309 may be formed at positions (for example, positions in the negative direction of the Z axis with respect to high-frequency elements 303) corresponding to two high-frequency elements 303, respectively, on the lower surface of first dielectric 301.

Each conductor 309 is provided with slot 307. The position of slot 307 in conductor 309 may illustratively be a center of or near the center of conductor 309. Slot 307 corresponds to a cut-out portion in which a part of conductor 309 is cut out into an elongated rectangular shape in the Y-axis direction. The cut-out portion may be referred to as "slit", "notch" or "gap". A width direction of slot 307 is the X-axis direction, and a length direction of slot 307 is the Y-axis direction. Slot 307 has a length in the Y-axis direction of, for example, $\lambda_{e1}/2$ or less.

Two high-frequency power supply lines 308 are, for example, provided corresponding to two high-frequency elements 303, on the lower surface of second dielectric 302. High-frequency power supply lines 308 have each, for example, an elongated rectangular shape in the X-axis direction, and are disposed at positions of second dielectric 302 overlapping slots 307 in plan view, each with a distance in the negative direction of the Z axis with respect to slot 307. One end of each high-frequency power supply line 308 is provided with high-frequency power supplier 310.

For example, high-frequency power supplier 310 supplies power to high-frequency element 303 by electromagnetic field coupling with high-frequency element 303. For example, the power supplied from high-frequency power supplier 310 is transmitted to high-frequency element 303 via high-frequency power supply line 308 and slot 307. For example, high-frequency power supplier 310 is electrically connected to a high-frequency radio controller (not illustrated). The high-frequency radio controller controls the power supply to high-frequency element 303.

As described above, in the present embodiment, conductor 309, high-frequency power supply line 308, and high-frequency power supplier 310 are disposed in each of two high-frequency elements 303.

A configuration in which high-frequency element 303, high-frequency power supply line 308, conductor 309 including slot 307, and high-frequency power supplier 310 are included, and in which radio waves of the first frequency band are radiated may be referred to as "high-frequency radiator" for convenience.

Next, a positional relationship between slot 307 and high-frequency power supply line 308, and power supply to high-frequency element 303 will be described.

Figure 2A:
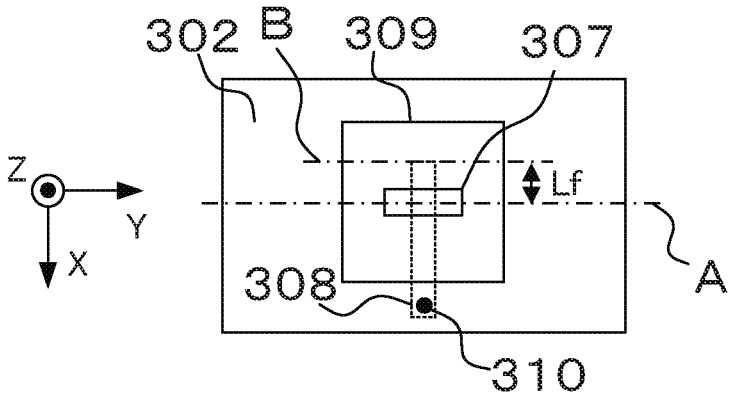
FIG. 2A is an enlarged view of a periphery of a slot and a high-frequency power supply line in a second dielectric.
Figure 2B:
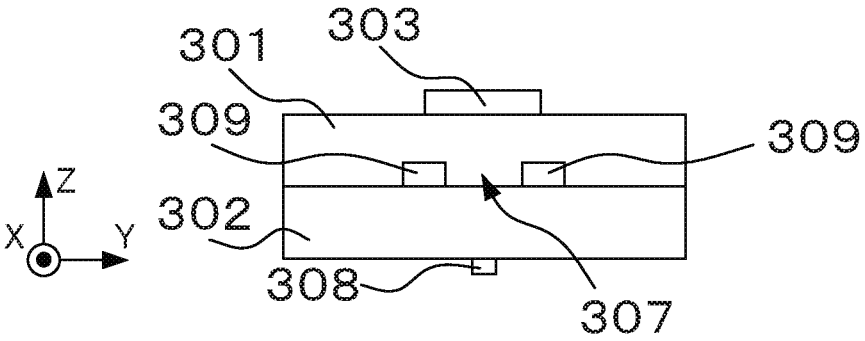
FIG. 2B is a cross-sectional view taken along line A of FIG. 2A.

FIG. 2A is an enlarged view of a periphery of slot 307 and high-frequency power supply line 308 in second dielectric 302. FIG. 2B is a cross-sectional view taken along line A of FIG. 2A. Note that, FIG. 2B illustrates, in addition to slot 307 and high-frequency power supply line 308 provided in second dielectric 302, high-frequency element 303 provided in first dielectric 301.

When slot 307 is excited by power supply from high-frequency power supplier 310 via high-frequency power supply line 308, an electric field is generated in the X-axis direction that is the width direction of slot 307. As a result of electromagnetic field coupling between an electromagnetic field radiated from slot 307 and high-frequency element 303, high-frequency element 303 is excited. In this case, a polarization direction of high-frequency element 303 is the X-axis direction as with the direction of the electric field of slot 307.

As a result of the power supply from high-frequency power supplier 310, slot 307 is excited via high-frequency power supply line 308. In FIG. 2A, distance Lf between line B along an end portion of high-frequency power supply line 308 and line A along an approximate center in the X-axis direction of slot 307 may be set to, for example, $\lambda_{e1}/4$.

By setting distance Lf to $\lambda_{e1}/4$, efficient electromagnetic field coupling between high-frequency power supply line 308 and slot 307 takes place.

With the above configuration, the power supply from high-frequency power supplier 310 causes slot 307 to be excited via high-frequency power supply line 308. Further, as a result of electromagnetic field coupling between slot 307 and high-frequency element 303, radio waves are radiated from high-frequency element 303, for example, in the positive direction of the Z axis.

Here, slot 307 has a cutoff characteristic with respect to the second frequency band. For example, the cutoff frequency is defined by a length in the Y-axis direction of slot 307. For example, the length in the Y-axis direction of slot 307 is defined such that the second resonance frequency included in the second frequency band corresponds to the cutoff frequency. Alternatively, a length in the longitudinal direction of slot 307 may be defined such that a frequency between the first frequency band and the second frequency band corresponds to the cutoff frequency. By providing slot 307 having the cutoff characteristic with respect to the second frequency band, it is possible to restrain power of the second frequency band from reaching high-frequency power supply line 308. Note that, slot 307 having the cutoff characteristic with respect to the second frequency band prevents or inhibits transmission of power of a frequency lower than the cutoff frequency, and, therefore, has a cutoff characteristic with respect to a frequency band lower than the second frequency band.

By providing slot 307, it is possible to restrain, for example, an influence exerted by operation of the low-frequency radiator on operation of the high-frequency radiator. As a result, for example, multiband antenna 300 of the embodiment does not require a blocking circuit for blocking power transmission from the low frequency band to the high frequency band. Accordingly, it is possible to simplify the configuration of multiband antenna 300.

Slot 307 may be provided at a position deviated in the X-axis direction from a center of a length in the X-axis direction of conductor 309. Further, slot 307 may be provided at a position deviated in the Y-axis direction from a center of a length of the Y-axis direction of conductor 309.

Next, the position at which radiation element connection line 305 is connected to high-frequency element 303 will be described.

Figure 3:
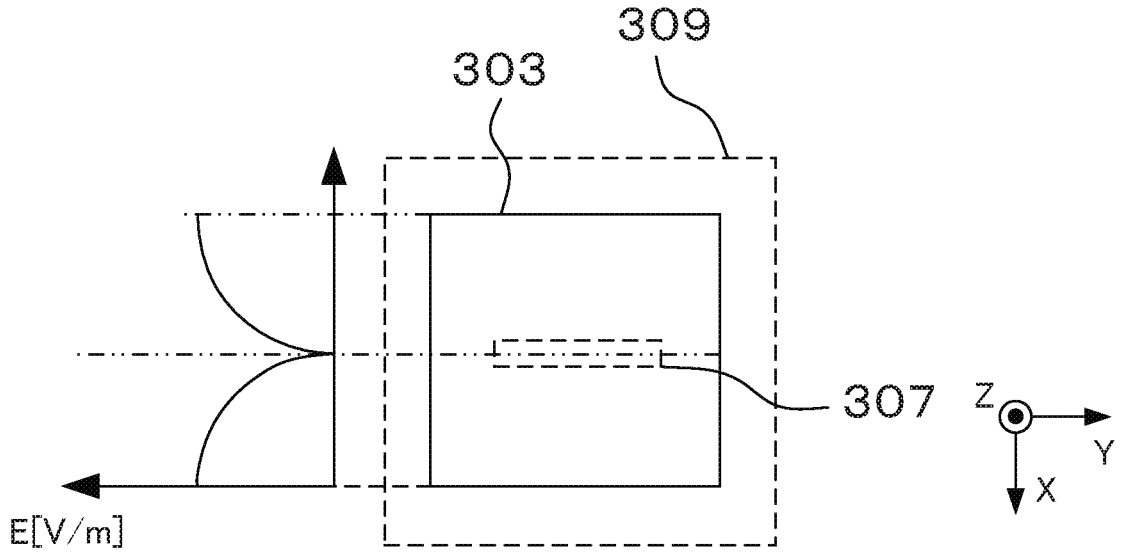
FIG. 3 illustrates an example of an electric field distribution of a high-frequency element.

FIG. 3 illustrates an example of an electric field distribution of high-frequency element 303. FIG. 3 illustrates high-frequency element 303, and a graph of electric field distribution in a polarization direction (the X-axis direction) of high-frequency element 303.

The vertical axis of the electric field distribution indicates the position in the X-axis direction of high-frequency element 303, and the horizontal axis of the electric field distribution indicates the electric field value at the position in the X-axis direction of high-frequency element 303.

Since the polarization direction of high-frequency element 303 is the X-axis direction and an end portion of high-frequency element 303 is an open end, standing waves are generated in the X-axis direction. The electric field value takes the maximum value in the end portion of high-frequency element 303, and takes the minimum value in a center portion in the X-axis direction of high-frequency element 303.

Radiation element connection line 305 is connected to the center portion in the X-axis direction of high-frequency element 303, in which the electric field value takes the minimum value. This connection prevents or inhibits power from flowing from high-frequency element 303 to radiation element connection line 305. Accordingly, it is possible to improve isolation characteristic between the high-frequency radiator and the low-frequency radiator. For this reason, for example, multiband antenna 300 of the embodiment does not require a blocking circuit that blocks power transmission from the high frequency band to the low frequency band. Accordingly, it is possible to simplify the configuration of multiband antenna 300.

Further, for example, a connection between radiation element connection line 305 connecting between two high-frequency elements 303 and respective center portions in the X-axis direction of two high-frequency elements 303 prevents or inhibits an electric current from flowing between high-frequency elements 303. Accordingly, it is possible to improve isolation characteristic between two high-frequency radiators.

As described above, in multiband antenna 300 according to the present embodiment, high-frequency elements 303, low-frequency elements 304, and radiation element connection lines 305 that connect between high-frequency element 303 and low-frequency element 304 and between two high-frequency elements 303 are provided on one surface (for example, the upper surface) of first dielectric 301. High-frequency element 303 has a resonance frequency in the first frequency band, and operates with linearly polarized waves in the polarization direction (the X-axis direction). Radiation element connection line 305 is connected to a center portion of high-frequency element 303, in a direction along a polarization direction of radiated radio waves generated by resonance. Further, conductor 309 including slot 307 is provided at a position facing high-frequency element 303 in an interior of the multilayer substrate including first dielectric 301 and second dielectric 302.

With the above configuration, it is possible to improve the isolation characteristic between the low-frequency radiator and the high-frequency radiator. For example, since radiation element connection line 305 is connected to positions with a small electric field of high-frequency elements 303, it is possible to restrain power flowing from high-frequency element 303 to low-frequency element 304, and to restrain an influence exerted by the operation of the high-frequency radiator on the low-frequency radiator. Further, since slot 307 restrains transmission of power of the second frequency band, it is possible to restrain an influence exerted by the operation of the low-frequency radiator on the high-frequency radiator.

Further, the above configuration does not require providing a blocking circuit (for example, a stub or a band blocking filter), and therefore is a simple configuration and adaptable to a plurality of frequency bands.

Further, since radiation element connection line 305 connecting between high-frequency elements 303 included in two of the high-frequency radiators, respectively, is connected to the positions with a small electric field of high-frequency elements 303, it is possible to restrain an electric current flowing between high-frequency elements 303, and to restrain an influence exerted by operation of one high-frequency radiator on another high-frequency radiator.

Further, in multiband antenna 300, it is possible to control the directivity of radio waves radiated from high-frequency element 303 by adjusting a phase value and/or a value of power supplied by the high-frequency radio controller to two high-frequency power suppliers 310. The directivity control refers to control of a direction of a peak (main lobe) and/or a level of a side lobe at a radiation pattern of a radio wave. In multiband antenna 300, it is possible to control the directivity of a Y-Z plane by the arrangement of two high-frequency elements 303 on the X-Y plane in the Y-axis direction. Note that, the method of the directivity control, for example, the method of adjusting a phase value and/or a value of power supplied to each high-frequency power supplier 310 may be a publicly known method regarding directivity control of an array antenna.

Note that, the example of multiband antenna 300 described above indicates a case where multiband antenna 300 includes two high-frequency elements 303 and two low-frequency elements 304. The present disclosure is not limited thereto. For example, the number of low-frequency elements 304 may be one or three or more. Further, the number of high-frequency elements 303 may be one or three or more. In Variation 1 below, a multiband antenna including four high-frequency elements 303 will be described.

(Variation 1)

Figure 4:
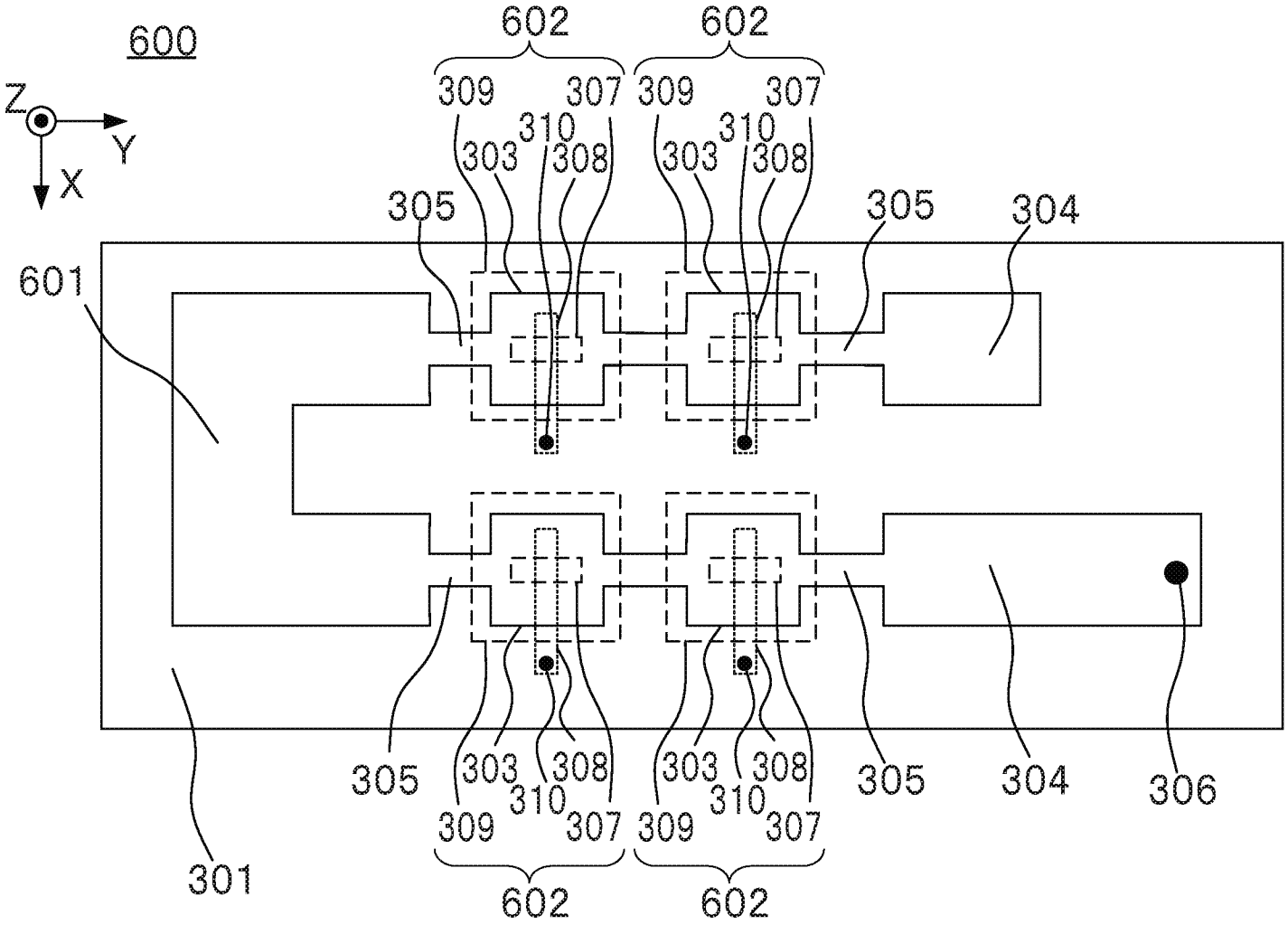
FIG. 4 is a plan view of an example of a multiband antenna according to Variation 1 of the embodiment of the present disclosure.

FIG. 4 is a plan view of an example of multiband antenna 600 according to Variation 1 of the embodiment of the present disclosure. In FIG. 4, the same configurations as those of FIGS. 1A to 1C are denoted by the same reference signs, and descriptions thereof are omitted as appropriate.

In multiband antenna 600 illustrated in FIG. 4, four high-frequency elements 303, two low-frequency elements 304, and bent portion 601 are formed on an upper surface of first dielectric 301. Further, radiation element connection lines 305 that connect between high-frequency elements 303, between low-frequency element 304 and high-frequency element 303, and between high-frequency element 303 and bent portion 601, respectively, are formed on the upper surface of first dielectric 301.

A side of a rear surface (in the negative direction of the Z axis) of each of four high-frequency elements 303 is provided with conductor 309 including slot 307, high-frequency power supply line 308, and high-frequency power supplier 310.

In multiband antenna 600 illustrated in FIG. 4, two high-frequency radiators 602 are arranged in the X-axis direction and two high-frequency radiators 602 are arranged in the Y-axis direction. In this case, two sets of high-frequency elements 303, where a set is composed of two high-frequency elements 303, are arranged in parallel on the upper surface of first dielectric 301.

Bent portion 601 includes a part extending in the X-axis direction and a part extending in the Y-axis direction. Bent portion 601 is provided, for example, so as to connect two high-frequency elements 303 aligned in the X-axis direction via radiation element connection lines 305, in the most negative direction of the Y axis. Note that, bent portion 601 may be referred to as one "low-frequency element".

In multiband antenna 600, a length of a line along a pattern (a low-frequency antenna pattern in multiband antenna 600) to which low-frequency elements 304, radiation element connection lines 305, high-frequency elements 303, and bent portion 601 are connected is set to $\lambda_{e2}/4\times N$ (where N is an integer of one or more). With this setting, the low frequency antenna pattern operates in the second frequency band.

With the above configuration, multiband antenna 600 illustrated in FIG. 4 makes it possible to improve the isolation characteristic between the low-frequency radiator and the high-frequency radiator as with multiband antenna 300 illustrated in FIGS. 1A to 1C.

Further, radiation element connection lines 305 that connect between high-frequency elements 303 included in four high-frequency radiators 602, respectively, are connected to positions with a small electric field of high-frequency elements 303. Accordingly, it is possible to restrain an electric current flowing between high-frequency elements 303, and to restrain an influence exerted by operation of one high-frequency radiator on another high-frequency radiator.

Further, in multiband antenna 600 illustrated in FIG. 4, two high-frequency radiators 602 are arranged in the X-axis direction and two high-frequency radiators 602 are arranged in the Y-axis direction. Accordingly, in multiband antenna 600, it is possible to control the directivity of an X-Z plane and a Y-Z plane of radio waves radiated from high-frequency element 303 by adjusting a phase value and/or a value of power supplied by a high-frequency radio controller to four high-frequency power suppliers 310.

Note that, the examples of multiband antenna 300 and multiband antenna 600 described above indicate cases of multiband antennas adaptable to two frequency bands of a high frequency band (the first frequency band) and a low frequency band (the second frequency band). In Variation 2 below, a multiband antenna adaptable to three frequency bands will be described.

(Variation 2)

Figure 5:
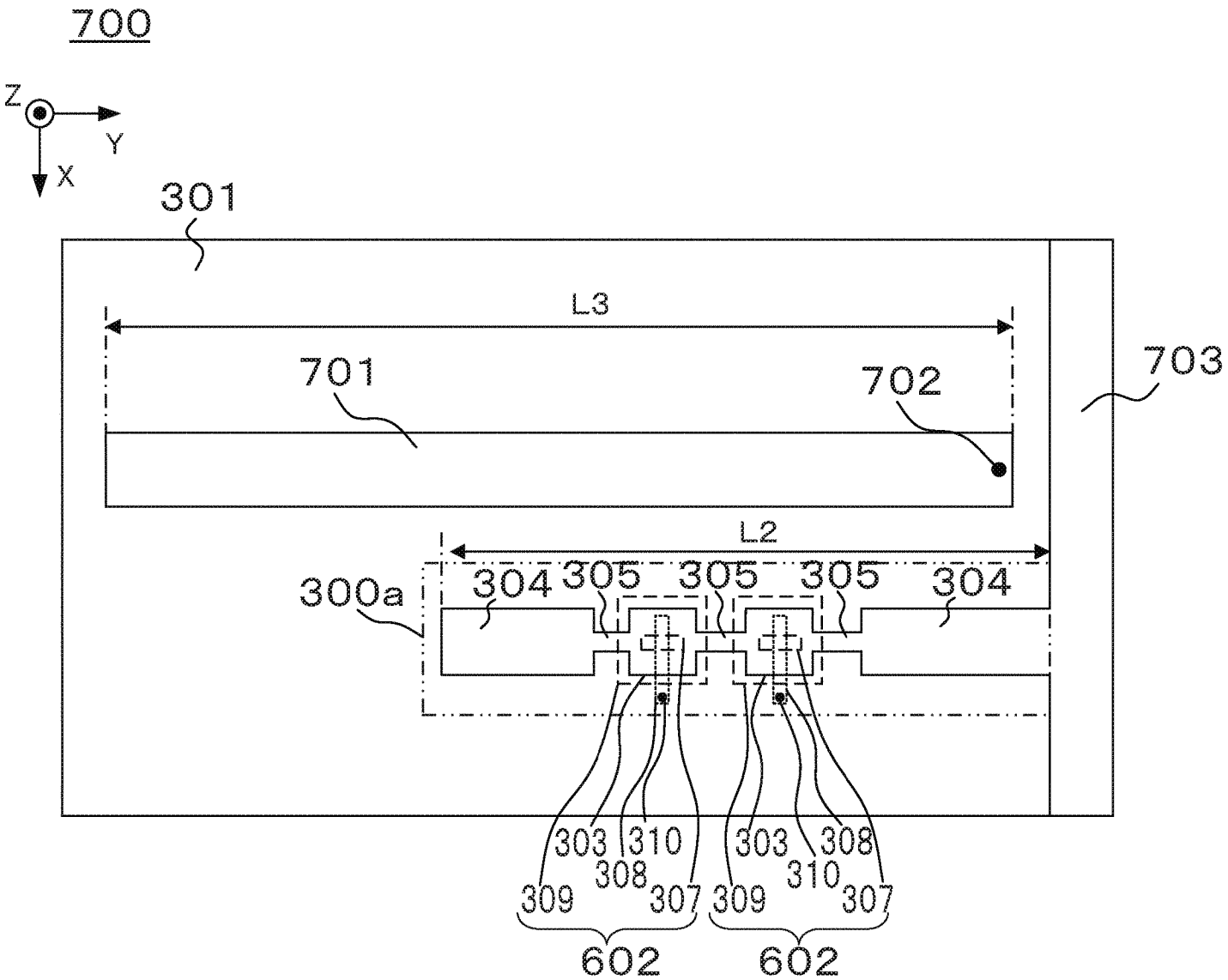
FIG. 5 is a plan view of an example of a multiband antenna according to Variation 2 of the embodiment of the present disclosure.

FIG. 5 is a plan view of an example of multiband antenna 700 according to Variation 2 of the embodiment of the present disclosure. Note that, in FIG. 5, the same configurations as those of FIGS. 1A to 1C and 4 are denoted by the same reference signs, and descriptions thereof are omitted as appropriate.

Multiband antenna 700 operates in three frequency bands. Hereinafter, the three frequency bands may be referred to as a first frequency band, a second frequency band, and a third frequency band in order from the higher frequency bands. For example, the first frequency band and the second frequency band are 28 GHz band and 2 GHz band, respectively, as with those in the example of multiband antenna 300. Further, the third frequency band is, for example, 800 MHz band.

Multiband antenna 700 illustrated in FIG. 5 includes antenna 300*a*, radiation element 701, power supplier 702, and ground pattern 703.

Radiation element 701 and ground pattern 703 are formed on an upper surface of first dielectric 301 by conductor patterns. Power supplier 702 is provided, for example, in one end portion of radiation element 701.

Antenna 300*a* is the same as multiband antenna 300 except that low-frequency power supplier 306 is not provided and that an end portion of one low-frequency element 304 is connected to ground pattern 703. Antenna 300*a* includes high-frequency radiator 602 operating in the first frequency band and a low-frequency radiator operating in the second frequency band.

The low frequency radiator includes low frequency element 304 and radiation element connection line 305, and has a low-frequency antenna pattern extending in the Y-axis direction. Further, in multiband antenna 700, power supplier 702 supplies power of the second frequency band to the low-frequency antenna pattern of antenna 300*a*.

Radiation element 701 is an antenna element operating in the third frequency band, in other words, having a resonance frequency (referred to as "third resonance frequency" for convenience) in the third frequency band. For example, total length L3 of radiation element 701 is $\lambda_{e3}/4\times N$ (where N is an integer of one or more). $\lambda_{e3}$ is an effective wavelength which corresponds to the third resonance frequency, and in which a wavelength reduction of a dielectric is taken into consideration. For example, $\lambda_{e3}$ is a wavelength obtained by multiplying a wavelength of the third resonance frequency in a vacuum by a coefficient determined based on a relative permittivity of the dielectric. Note that, the dielectric to be taken into consideration represents, for example, both first dielectric 301 and second dielectric 302 (see FIGS. 1A and 1B).

As described above, power supplier 702 supplies power of the second frequency band to the low-frequency antenna pattern of antenna 300*a*. Further, power supplier 702 supplies power of the third frequency band to radiation element 701. Power supplier 702 is electrically connected to a radio controller (not illustrated). The radio controller controls the power supplies of the two frequency bands.

Ground pattern 703 transmits power of the second frequency band supplied from power supplier 702 to the low-frequency antenna pattern. Further, a part of ground pattern 703 functions as a ground wire in a case where the low-frequency radiator operates in antenna 300*a*.

With the above configuration, multiband antenna 700 illustrated in FIG. 5 is adaptable to three frequency bands of the first frequency band, the second frequency band, and the third frequency band.

Further, as with multiband antenna 300 illustrated in FIGS. 1A to 1C, multiband antenna 700 illustrated in FIG. 5 is capable of improving isolation characteristic between the low-frequency radiator and high-frequency radiator 602, and isolation characteristic between two high-frequency radiators 602.

Further, as with multiband antenna 300 illustrated in FIGS. 1A to 1C, a connection between radiation element connection line 305 and a center portion in the X-axis direction of high-frequency element 303 prevents or inhibits an electric current from flowing from high-frequency element 303 to radiation element connection line 305. Accordingly, a flow of an electric current from high-frequency element 303 to power supplier 702 is prevented or obstructed, and it is possible to improve the isolation characteristic.

Further, since slot 307 has a cutoff characteristic with respect to the second frequency band and the third frequency band, it is possible to improve isolation characteristic between radiation element 701 that performs operation of the antenna of the third frequency band and high-frequency radiator 602.

Further, length L3 of radiation element 701 and length L2 of the low-frequency antenna pattern are defined based on the corresponding resonance frequencies, respectively. Accordingly, in a case where power supplier 702 supplies power of each of two frequency bands, one of radiation element 701 and the low-frequency antenna pattern does not affect the other. For example, in a case where power supplier 702 supplies power of the second frequency band, radiation element 701 is not excited. Further, in a case where power supplier 702 supplies power of the third frequency band, the low-frequency antenna pattern is not excited.

Note that, the numerical values of the first to third frequency bands described above are merely exemplary, and the present disclosure is not limited thereto.

Further, the notation " . . . section" or "-er, -or, and -ar" used in the description of each embodiment described above may be replaced with other notations such as " . . . circuitry", " . . . device", and " . . . module".

The present disclosure can be realized by software, hardware, or software in cooperation with hardware.

Each functional block used in the description of the each embodiment described above can be partly or entirely realized by an LSI such as an integrated circuit, and each process described in the embodiment may be controlled partly or entirely by the same LSI or a combination of LSIs. The LSI may be individually formed as chips, or one chip may be formed so as to include a part or all of the functional blocks. The LSI may include a data input and output coupled thereto. The LSI here may be referred to as an IC, a system LSI, a super LSI, or an ultra LSI depending on a difference in the degree of integration.

However, the technique of implementing an integrated circuit is not limited to the LSI and may be realized by using a dedicated circuit, a general-purpose processor, or a special-purpose processor. In addition, a FPGA (Field Programmable Gate Array) that can be programmed after the manufacture of the LSI or a reconfigurable processor in which the connections and the settings of circuit cells disposed inside the LSI can be reconfigured may be used. The present disclosure can be realized as digital processing or analogue processing.

If future integrated circuit technology replaces LSIs as a result of the advancement of semiconductor technology or other derivative technology, the functional blocks could be integrated using the future integrated circuit technology. Biotechnology can also be applied.

The present disclosure can be realized by any kind of apparatus, device or system having a function of communication, which is referred to as a communication apparatus. Some non-limiting examples of such a communication apparatus include a phone (e.g. cellular (cell) phone, smart phone), a tablet, a personal computer (PC) (e.g. laptop, desktop, netbook), a camera (e.g. digital still/video camera), a digital player (digital audio/video player), a wearable device (e.g. wearable camera, smart watch, tracking device), a game console, a digital book reader, a telehealth/telemedicine (remote health and medicine) device, and a vehicle providing communication functionality (e.g. automotive, airplane, ship), and various combinations thereof.

The communication apparatus is not limited to be portable or movable, and may also include any kind of apparatus, device or system being non-portable or stationary, such as a smart home device (e.g. an appliance, lighting, smart meter, control panel), a vending machine, and any other "things" in a network of an "Internet of Things (IoT)".

The communication may include exchanging data through, for example, a cellular system, a wireless LAN system, a satellite system, etc., and various combinations thereof.

The communication apparatus may comprise a device such as a controller or a sensor which is coupled to a communication device performing a function of communication described in the present disclosure. For example, the communication apparatus may comprise a controller or a sensor that generates control signals or data signals which are used by a communication device performing a communication function of the communication apparatus.

The communication apparatus also may include an infrastructure facility, such as a base station, an access point, and any other apparatus, device or system that communicates with or controls apparatuses such as those in the above non-limiting examples.

Various embodiments have been described above with reference to the drawings. However, it goes without saying that the present disclosure is not limited to these embodiments. It is obvious that one of ordinary skill in the art can conceive various modified examples and correction examples within the scope recited in the claims. It should be naturally understood that these modified examples and correction examples belong to the technical scope of the present disclosure. Furthermore, each component of the above embodiment may be optionally combined without departing from the gist of the disclosure.

An antenna apparatus in an embodiment of the present disclosure includes: at least one first radiation element provided on one surface of a substrate and having a resonance frequency in a first frequency band; at least one second radiation element provided on the one surface of the substrate; a connection line connecting between the first radiation element and the second radiation element on the one surface of the substrate; a conductor provided at a position facing the first radiation element in an interior of the substrate and including a slot; and a power supply line supplying power to the first radiation element via the slot, wherein the connection line is connected to a center portion of the first radiation element, in a direction along a polarization direction of radiated radio waves generated by resonance, and a line length formed by the first radiation element, the connection line, and the second radiation element is set to a length so as to have a resonance frequency in a second frequency band lower than the first frequency band.

The antenna apparatus of the embodiment of the present disclosure includes a plurality of the first radiation elements, wherein the connection line connects between respective center portions of the plurality of first radiation elements.

In the antenna apparatus of the embodiment of the present disclosure, power supply in which at least one of a phase value and a power value is controlled is performed from the power supply line to the plurality of first radiation elements.

In the antenna apparatus of the embodiment of the present disclosure, the plurality of first radiation elements are disposed in the polarization direction and in a direction vertical to the polarization direction, and the second radiation element includes a part extending along the polarization direction, and a part extending along the direction vertical to the polarization direction.

The antenna apparatus of the embodiment of the present disclosure includes: a third radiation element provided on the one surface of the substrate and having a resonance frequency in a third frequency band lower than the second frequency band; a ground pattern connected to the second radiation element on the one surface of the substrate and coupled with the third radiation element in an electromagnetic field coupling manner; and a power supplier provided in the third radiation element, supplying power of the second frequency band to the second radiation element, and supplying power of the third frequency band to the third radiation element.

In the antenna apparatus of the embodiment of the present disclosure, an insulation layer is provided between the first radiation element and the conductor, and between the conductor and the power supply line.

In the antenna apparatus of the embodiment of the present disclosure, the conductor has a larger size than the first radiation element.

The disclosure of Japanese Patent Application No. 2018-076909, filed on Apr. 12, 2018, including the specification, drawings and abstract, is incorporated herein by reference in its entirety.

INDUSTRIAL APPLICABILITY

The embodiment of the present disclosure is suitable for use in a small radio communication apparatus.

REFERENCE SIGNS LIST

300, 600, 700 Multiband antenna
300*a* Antenna
301 First dielectric
302 Second dielectric
303 High-frequency element
304 Low-frequency element
305 Radiation element connection line
306 Low-frequency power supplier
307 Slot
308 High-frequency power supply line
309 Conductor
310 High-frequency power supplier
601 Bent portion
602 High-frequency radiator
701 Radiation element
702 Power supplier
703 Ground pattern

The invention claimed is:

1. An antenna apparatus, comprising:

at least one first radiation element provided on one surface of a substrate and having a resonance frequency in a first frequency band;

at least one second radiation element provided on the one surface of the substrate;

a connection line connecting between the first radiation element and the second radiation element on the one surface of the substrate;

a conductor provided at a position facing the first radiation element in an interior of the substrate and including a slot; and a power supply line supplying power to the first radiation element via the slot, wherein the connection line is connected to a center portion of the first radiation element, in a direction along a polarization direction of radiated radio waves generated by resonance, and a line length formed by the first radiation element, the connection line, and the second radiation element is set to a length so as to have a resonance frequency in a second frequency band lower than the first frequency band.

2. The antenna apparatus according to claim 1, comprising a plurality of the first radiation elements, wherein:

the connection line connects between respective center portions of the plurality of first radiation elements.

3. The antenna apparatus according to claim 2, wherein:

power supply in which at least one of a phase value and a power value is controlled is performed from the power supply line to the plurality of first radiation elements.

4. The antenna apparatus according to claim 2, wherein:

the plurality of first radiation elements are disposed in the polarization direction and in a direction vertical to the polarization direction, and the second radiation element includes a part extending along the polarization direction, and a part extending along the direction vertical to the polarization direction.

5. The antenna apparatus according to claim 1, comprising:

a third radiation element provided on the one surface of the substrate and having a resonance frequency in a third frequency band lower than the second frequency band;

a ground pattern connected to the second radiation element on the one surface of the substrate and coupled with the third radiation element in an electromagnetic field coupling manner; and a power supplier provided in the third radiation element, supplying power of the second frequency band to the second radiation element, and supplying power of the third frequency band to the third radiation element.

6. The antenna apparatus according to claim 1, wherein:

an insulation layer is provided between the first radiation element and the conductor, and between the conductor and the power supply line.

7. The antenna apparatus according to claim 1, wherein:

the conductor has a larger size than the first radiation element.

* * * * *